US012590414B2

(12) United States Patent
Chen et al.

(10) Patent No.: US 12,590,414 B2
(45) Date of Patent: Mar. 31, 2026

(54) PAPER AND PULP FOAM CONTROL AGENT

(71) Applicants: Dow Global Technologies LLC, Midland, MI (US); Dow Silicones Corporation, Midland, MI (US)

(72) Inventors: Xue Chen, Manvel, TX (US); Haseeb Moten, Midland, MI (US)

(73) Assignees: Dow Global Technologies LLC, Midland, MI (US); Dow Silicones Corporation, Midland, MI (US)

( * ) Notice: Subject to any disclaimer, the term of this patent is extended or adjusted under 35 U.S.C. 154(b) by 182 days.

(21) Appl. No.: 18/248,165

(22) PCT Filed: Oct. 21, 2021

(86) PCT No.: PCT/US2021/055934
§ 371 (c)(1),
(2) Date: Apr. 6, 2023

(87) PCT Pub. No.: WO2022/093607
PCT Pub. Date: May 5, 2022

(65) Prior Publication Data

US 2023/0383469 A1 Nov. 30, 2023

Related U.S. Application Data

(60) Provisional application No. 63/105,385, filed on Oct. 26, 2020.

(51) Int. Cl.
*D21H 21/12* (2006.01)
*D21C 3/28* (2006.01)
*D21C 11/00* (2006.01)
*D21H 17/06* (2006.01)

(52) U.S. Cl.
CPC ..... *D21H 21/12* (2013.01); *D21C 3/28* (2013.01); *D21C 11/0085* (2013.01); *D21H 17/06* (2013.01)

(58) Field of Classification Search
CPC ..... D21H 21/12; D21H 17/06; D21C 3/28
See application file for complete search history.

(56) References Cited

U.S. PATENT DOCUMENTS

| | | | |
|---|---|---|---|
| 4,071,468 | A | 1/1978 | Abel et al. |
| 4,421,666 | A | 12/1983 | Hempel et al. |
| 5,866,041 | A | 2/1999 | Svarz et al. |
| 5,874,017 | A | 2/1999 | Palmer et al. |
| 6,534,550 | B1 | 3/2003 | Walterick, Jr. |

(Continued)

FOREIGN PATENT DOCUMENTS

| | | | | |
|---|---|---|---|---|
| CA | 2760803 | A1 * | 12/2010 | ..... D21C 5/027 |
| CS | 274073 | B1 * | 4/1991 | |
| EP | 3842109 | | 6/2021 | |

(Continued)

OTHER PUBLICATIONS

English Machine translation of CS274073B1 (Year: 1991).*

(Continued)

*Primary Examiner* — Anthony Calandra

(57) ABSTRACT

A foam control agent and method of controlling foam for paper or pulp production by use of a foam control agent, wherein the agent comprises at least a branched alcohol.

5 Claims, 1 Drawing Sheet

(56) References Cited

U.S. PATENT DOCUMENTS

| | | | | |
|---|---|---|---|---|
| 7,879,917 | B2 | 2/2011 | Cheng et al. | |
| 2014/0363668 | A1* | 12/2014 | Fujita | C09J 123/0853 524/311 |

FOREIGN PATENT DOCUMENTS

| | | | | | |
|---|---|---|---|---|---|
| JP | 2008121138 | A | * | 5/2008 | |
| JP | 2013057142 | A | * | 3/2013 | D21C 5/027 |
| SE | 451382 | | | 10/1987 | |
| WO | 1998000216 | | | 1/1998 | |
| WO | 2019/042694 | | | 3/2019 | |

OTHER PUBLICATIONS

English Machine Translation JP2008121138A, 2008. (Year: 2008).*
English machine translation of JP2013057142A, 2013. (Year: 2013).*
PCT/US2021/055934 International Search Report and Written Opinion with a mailing date of Feb. 16, 2022.

* cited by examiner

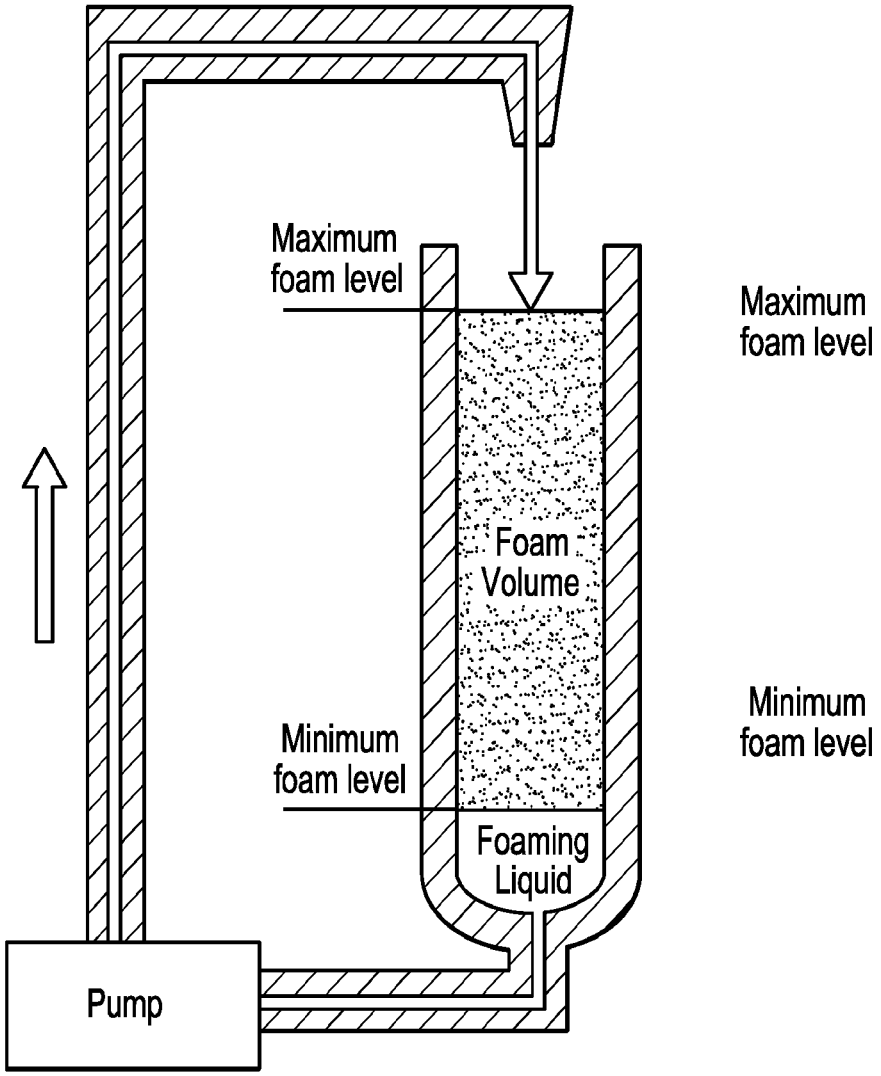
Maximum
foam level
Maximum
foam level
Foam
Volume
Minimum
foam level
Minimum
foam level
Foaming
Liquid
Pump

PAPER AND PULP FOAM CONTROL AGENT

Embodiments relate to a foam control agent and method of controlling foam for paper and pulp production, wherein the agent comprises at least a branched alcohol.

INTRODUCTION

In the Paper and Pulp industry, silicone-based foam control agents account for around one third of the foam control market. The foam control agents are primarily used during the washing step of pulp processing to control foam generated in the black liquor from fatty acids. Silicones, due to their low surface tension and unique chemistry are particularly suited for this application. The siloxane backbone is resistant to degradation leading to longer persistency in these caustic systems, however, silicone-based foam control agents have deposition concerns and provide lower knock down performance.

For all these reasons and more, there is a need for a foam control agent and method of controlling foam for pulp and paper.

SUMMARY

Embodiments relate to a foam control agent and method of controlling foam for paper and pulp production, wherein the agent comprises at least a branched alcohol.

BRIEF DESCRIPTION OF THE DRAWINGS

Various embodiments are disclosed in the following detailed description and accompanying drawings:

FIG. 1 is a diagram of pump test components

DETAILED DESCRIPTION

The present disclosure relates to a foam control agent for paper and pulp production. The present disclosure details how, unexpectedly, branched alcohols have been shown to have superior foam control performance. The branched alcohols may be 2-alkyl-1-alkanols (also known as Guerbet alcohols), and preferably 2-ethylhexanol (2-EH) and 2-propylheptanol (2-PH). These alcohols can be synthesized via the aldol condensation of the corresponding aldehydes or from the Guerbet reaction of primary linear alcohols. Other methods of production may also be utilized.

In this invention, C9 to C12 β-branched alcohols (C9-C12 Guerbet alcohols) were found to be surprisingly effective in reducing the foam of black liquor of paper and pulp. Another benefit to the branched alcohols is their very good biodegradability.

The generic structure of the antifoaming agent currently disclosed is as follows:

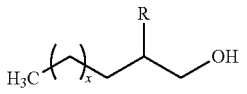

wherein x is an integer from 2 to 8 and R is an alkyl group with 1-8 carbon atoms.

The foam control agent may also be described as comprising a 2-alkyl substituted alcohol from C9-C12. The alcohols can be predominately one isomer (>95 wt. %) or a mixture of alcohols which can be generated by an aldol condensation of a mixture of aldehydes or generated from a mixture of alcohols via the Guerbet reaction.

The C8-C32 Guerbet alcohols including 2-ethylhexanol and 2-propylheptanol and the mixture of C8, C9, and C10 alcohols generated from the aldol condensation of butyraldehyde and valeraldehyde are preferred in some embodiments.

The concentration of the Guerbet alcohol in the formulated foam control agent ranges from 0.01% to 100%, preferably, ranging from 25% to 100% when used as antifoaming agent or defoaming agent. The Guerbet alcohol can be in the form of a solid or liquid, a liquid is preferred. If it is a solid, the material may be dissolved or dispersed in a solvent. The said foam control agent can be aqueous solution or organic solvent-based solution. The usage dosage of the said foam control agent for paper and pulp production varies from 0.01% to 5%, preferably, ranges from 0.1% to 1% (50-100 ppm).

Other foam control agents (e.g., copolymers composed of ethylene oxide, propylene oxide, and/or butylene oxide, random or blocks) or other hydrophobic materials such as waxes, oils or silicas may also be added with the branched, Guerbet alcohol(s). Silicone can be used in conjunction with the 2-alkyl alcohols. Surfactants, especially alkoxylates of the alcohols can also be used. The use of branched alcohols as foam control agents may be water based or oil based.

The new foam control agent presently disclosed may be in the form of a solid or liquid. If it is a solid, the material may be dissolved or dispersed in a solvent before use as a foam control agent. The presently disclosed agents are believed to work in the presence of all commonly used wastewater treatment process.

The chemical agent can be used both in antifoamer or defoamer formulations. Antifoamer formulations are obtained by the mixture of polyglycols, esters, silicones, solvents, water and other chemicals that in the gas-liquid interface of the bubble avoiding the foam formation. Other amphiphilic chemicals based on block copolymer can be used as well. In defoaming formulations, in addition to the products mentioned above, it can be used vegetal oils, mineral oils, waxes and other oily agents.

The optional surfactant or emulsifier contained in the foam control agent is selected to be suitable for improving the compatibility of the foam control agent on the feedstock or forming an emulsion with the composition of branched alcohol. The optional surfactant or emulsifier has an amount ranging from 0.1-30% by weight of the composition of branched alcohol.

The optional surfactant or emulsifier may be anionic, cationic or nonionic. Examples of suitable anionic surfactants or emulsifiers are alkali metal, ammonium and amine soaps; the fatty acid part of such soaps contains preferably at least 10 carbon atoms. The soaps can also be formed "in situ;" in other words, a fatty acid can be added to the oil phase and an alkaline material to the aqueous phase.

Other examples of suitable anionic surfactants or emulsifiers are alkali metal salts of alkyl-aryl sulfonic acids, sodium dialkyl sulfosuccinate, sulfated or sulfonated oils, e.g., sulfated castor oil; sulfonated tallow, and alkali salts of short chain petroleum sulfonic acids.

Suitable cationic surfactants or emulsifiers are salts of long chain primary, secondary or tertiary amines, such as oleylamide acetate, cetylamine acetate, di-dodecylamine lactate, the acetate of aminoethyl-aminoethyl stearamide, dilauroyl triethylene tetramine diacetate, 1-aminoethyl-2-heptadecenyl imidazoline acetate; and quaternary salts, such as cetylpyridinium bromide, hexadecyl ethyl morpholinium chloride, and diethyl di-dodecyl ammonium chloride.

Examples of suitable nonionic surfactants or emulsifiers are condensation products of higher fatty alcohols with ethylene oxide, such as the reaction product of oleyl alcohol with ethylene oxide units; condensation products of alkylphenols with ethylene oxide, such as the reaction product of isoctylphenol with 12 ethylene oxide units; condensation products of higher fatty acid amides with 5, or more, ethylene oxide units; polyethylene glycol esters of long chain fatty acids, such as tetraethylene glycol monopalmitate, hexaethyleneglycol monolaurate, nonaethyleneglycol monostearate, nonaethyleneglycol dioleate, tridecaethyleneglycol monoarachidate, tricosaethyleneglycol monobehenate, tricosaethyleneglycol dibehenate, polyhydric alcohol partial higher fatty acid esters such as sorbitan tristearate, ethylene oxide condensation products of polyhydric alcohol partial higher fatty acid esters, and their inner anhydrides (mannitol-anhydride, called Mannitan, and sorbitol-anhydride, called Sorbitan), such as glycerol monopalmitate reacted with 10 molecules of ethylene oxide, pentaerythritol monooleate reacted with 12 molecules of ethylene oxide, sorbitan monostearate reacted with 10-15 molecules of ethylene oxide, mannitan monopalmitate reacted with 10-15 molecules of ethylene oxide; long chain polyglycols in which one hydroxyl group is esterified with a higher fatty acid and other hydroxyl group is etherified with a low molecular alcohol, such as methoxypolyethylene glycol 550 monostearate (550 meaning the average molecular weight of the polyglycol ether). A combination of two or more of these surfactants may be used; e.g., a cationic may be blended with a nonionic or an anionic with a nonionic.

The foam control agent may further comprise one or more additives. Examples of additives include ethylene oxide/propylene oxide block copolymers, butylene oxide/propylene oxide block copolymers, ethylene oxide/butylene oxide block copolymers, waxes, or silicone-based materials. For other pulp and paper applications where surfactants cause foaming in pulp production steps, higher 2-alkyl substituted alcohols up to C32 can be used.

Examples

An experiment to test the efficacy of the presently disclosed foam control agent and others may be conducted as follows.

Materials

TABLE 1

Raw materials used for experiments

| Name | Producer/Vendor | Purpose | Chemistry and function |
|---|---|---|---|
| 2-ethylhexanol (2-EH) | Purchased from Sigma Aldrich | Novel Control Agent | 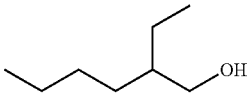 |
| 2-Propylheptanol (2-PH) | Purchased from Sigma Aldrich | Novel Control Agent | 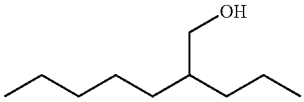 |
| Dowsil ACP-3073 Antifoam Compound | Dow Chemical | Comparative Benchmark | Silicone based foam control agent |
| Xiameter ACP-1400 Antifoam Compound | Dow Chemical | Comparative Benchmark | Silicone based foam control agent |
| Propylene Glycol | Purchased from Sigma Aldrich | Diluent for silicone compounds | 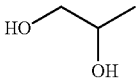 |
| Low foam Hardwood Black Liquor | Buckman | Foam medium for test | Aqueous solution of lignin, hemicellulose, sodium hydroxide, sodium sulfide and other organic and inorganic chemicals |
| High foam Hardwood Black liquor | Buckman | Foam medium for test | Aqueous solution of lignin, hemicellulose, sodium hydroxide, sodium sulfide and other organic and inorganic chemicals |
| Hardwood Black Liquor | Buckman | Foam medium for test | Aqueous solution of lignin, hemicellulose, sodium hydroxide, sodium sulfide and other organic and inorganic chemicals |

The tested examples and comparative examples are shown below in Table 2 (featuring the raw materials listed above in Table 1). Silicone antifoams were mixed with propylene glycol and then injected using positive displacement micropipettes directly into the recycle stream. Silicone emulsions were diluted in water and injected using positive displacement micropipettes directly into the recycle stream. To test effect of propylheptanol, it was injected with a second micropipette directly into the recycle stream at the same time as the silicone/propylene glycol mixture.

TABLE 2

Examples and Comparative Examples

| Examples | Foam control agent | amount | Actives Concentration | Type of Black Liquor |
|---|---|---|---|---|
| Example 1 | 2-Propylheptanol | 4 ml | 5000 ppm | High Foam |
| Example 2 | 2-Propylheptanol | 2 ml | 2500 ppm | High Foam |
| Example 3 | 2-Propylheptanol | 4 ml | 5000 ppm | Low Foam |
| Example 4 | 2-Propylheptanol | 2 ml | 2500 ppm | Low Foam |
| Example 5 | 2-Propylheptanol | 1 ml | 1250 ppm | Low Foam |
| Example 6 | 2-Propylheptanol and ACP-3073 | 50 uL 2-Propylheptanol 8 uL ACP-3073 792 uL propylene glycol | 10 ppm ACP-3073 + 62.5 ppm 2-Propylheptanol | Hardwood |
| Example 7 | 2-Propylheptanol and ACP-3073 | 50 uL 2-Propylheptanol 1.6 uL ACP-3073 798.4 uL propylene glycol | 2 ppm ACP-3073 + 62.5 ppm 2-Propylheptanol | Hardwood |
| Example 8 | 2-Propylheptanol and ACP-1400 | 50 uL 2-Propylheptanol 8 uL ACP-1400 792 uL propylene glycol | 10 ppm ACP 1400 + 62.5 ppm 2PH | Hardwood |
| Comparative Example 1 | 2-Ethylhexanol | 2 ml | 2500 ppm | High Foam |
| Comparative Example 2 | 2-Ethylhexanol | 4 ml | 5000 ppm | Low Foam |
| Comparative Example 3 | 2-Ethylhexanol | 2 ml | 2500 ppm | Low Foam |
| Comparative Example 4 | 2-Ethylhexanol | 1 ml | 1250 ppm | Low Foam |
| Comparative Example 5 | 3104 (4% 3073) | 200 μl | 10 ppm | High Foam |
| Comparative Example 6 | 3104 (4% 3073) | 20 μl | 1 ppm | Low Foam |
| Comparative example 7 | ACP-3073 | 8 uL ACP-3073 792 uL propylene glycol | 10 ppm | High Foam |
| Comparative example 8 | ACP-3073 | 1.6 uL ACP-3073 798.4 uL propylene glycol | 2 ppm | High Foam |
| Comparative example 9 | ACP 1400 | 8 uL ACP-1400 792 uL propylene glycol | 10 ppm | High Foam |

Testing Methodology

To test the foam control performance, a pump test was utilized. The pump test is composed of three components: a 2 L clear jacketed glass open top glass column with a valve at the bottom. A cell heater recirculating silicone fluid through the jacket to maintain temperature. A centrifugal pump with the inlet attached to the bottom valve of the column and the outlet going into the top of the open glass column to recirculate the foaming medium. FIG. 1 is a diagram of the pump test components.

To conduct the pump test with the components described above, 800 mL of the foaming medium (high, low foam, or hardwood black liquor) was heated in a 1 L Erlenmeyer flask to 95° C. on a stirring hotplate. The top of the flask was covered loosely with a small cap to minimize evaporation. Once heated, foaming medium was carefully poured into the 2 L glass column that had been preheated to 110 C. The antifoams are then loaded into micropipettes. The recirculating pump is turned on and the foam is monitored until it hits 1700 mL in the column and then the antifoam is injected directly into the recycle stream. Foam Volume is monitored until foam returns to the maximum 1700 mL level or ten minutes have passed, whichever comes first.

Results

As shown in Table 3 below, 0.5% (5000 ppm) 2-PH in high foam black liquor has a significant improvement in foam knock down comparing with the silicone-based foam control agent 3104. This 2-PH alcohol presents good persistence performance. Also shown in Table 3, 0.125% (1250 ppm) 2-PH in low foam black liquor has a better performance in terms of knock down performance and similar persistence performance to the benchmark 3104. 2-EH alcohol comparative examples are also evaluated, as shown in Table 3, they are not as effective as 2-PH alcohol.

TABLE 3

Experimental results of single chemical as defoamer

| | Examples | | | | | | | | | | |
|---|---|---|---|---|---|---|---|---|---|---|---|
| Time (seconds) | Example 1 Foam Volume (mL) | Example 2 Foam Volume (mL) | Example 3 Foam Volume (mL) | Example 4 Foam Volume (mL) | Example 5 Foam Volume (mL) | Comparative Example 1 Foam Volume (mL) | Comparative Example 2 Foam Volume (mL) | Comparative Example 3 Foam Volume (mL) | Comparative Example 4 Foam Volume (mL) | Comparative Example 5 Foam Volume (mL) | Comparative Example 6 Foam Volume (mL) |
| 0 | 1000 | 1000 | 1000 | 1000 | 1000 | 1000 | 1000 | 1000 | 1000 | 1000 | 1000 |
| 5 | 400 | 800 | 300 | 400 | 500 | 900 | 400 | 200 | 200 | 900 | 500 |
| 10 | 320 | 400 | 200 | 200 | 200 | 900 | 200 | 200 | 200 | 600 | 380 |
| 15 | 300 | 300 | 200 | 200 | 200 | 760 | 200 | 200 | 200 | 400 | 320 |
| 20 | 300 | 300 | 200 | 200 | 200 | 520 | 200 | 200 | 200 | 340 | 300 |

TABLE 3-continued

Experimental results of single chemical as defoamer

| | Examples | | | | | | | | | | |
|---|---|---|---|---|---|---|---|---|---|---|---|
| Time (seconds) | Example 1 Foam Volume (mL) | Example 2 Foam Volume (mL) | Example 3 Foam Volume (mL) | Example 4 Foam Volume (mL) | Example 5 Foam Volume (mL) | Comparative Example 1 Foam Volume (mL) | Comparative Example 2 Foam Volume (mL) | Comparative Example 3 Foam Volume (mL) | Comparative Example 4 Foam Volume (mL) | Comparative Example 5 Foam Volume (mL) | Comparative Example 6 Foam Volume (mL) |
| 25 | 300 | 300 | 200 | 200 | 200 | 300 | 200 | 200 | 220 | 340 | 340 |
| 30 | 300 | 320 | 200 | 200 | 200 | 350 | 200 | 200 | 220 | 340 | 340 |
| 35 | 300 | 320 | 200 | 200 | 200 | 400 | 200 | 200 | 240 | 340 | 360 |
| 40 | 300 | 320 | 200 | 200 | 200 | 500 | 200 | 200 | 240 | 340 | 360 |
| 45 | 300 | 340 | 200 | 200 | 200 | 600 | 200 | 200 | 240 | 340 | 360 |
| 50 | 300 | 360 | 200 | 200 | 200 | 700 | 200 | 200 | 260 | 340 | 360 |
| 55 | 300 | 380 | 200 | 200 | 200 | 780 | 200 | 200 | 280 | 340 | 360 |
| 60 | 300 | 400 | 200 | 200 | 220 | 900 | 200 | 200 | 280 | 360 | 360 |
| 70 | 300 | 420 | 200 | 200 | 220 | 1000 | 200 | 200 | 300 | 360 | 360 |
| 80 | 300 | 440 | 200 | 200 | 220 | | 200 | 200 | 320 | 360 | 360 |
| 90 | 300 | 440 | 200 | 200 | 220 | | 200 | 200 | 320 | 360 | 360 |
| 100 | 300 | 460 | 200 | 200 | 220 | | 200 | 200 | 320 | 360 | 360 |
| 110 | 300 | 460 | 200 | 200 | 220 | | 200 | 200 | 320 | 360 | 380 |
| 120 | 300 | 480 | 200 | 200 | 220 | | 200 | 200 | 360 | 360 | 380 |
| 130 | 300 | 480 | 200 | 200 | 220 | | 200 | 200 | 380 | 380 | 380 |
| 140 | 300 | 500 | 200 | 200 | 220 | | 200 | 200 | 420 | 380 | 380 |
| 150 | 300 | 500 | 200 | 200 | 220 | | 200 | 200 | 460 | 380 | 400 |
| 160 | 300 | 510 | 200 | 200 | 220 | | 200 | 200 | 460 | 380 | 400 |
| 170 | 300 | 520 | 200 | 200 | 220 | | 200 | 200 | 480 | 380 | 400 |
| 180 | 300 | 540 | 200 | 200 | 220 | | 200 | 200 | 500 | 380 | 400 |
| 190 | 300 | 560 | 200 | 200 | 220 | | 200 | 220 | 520 | 380 | 400 |
| 200 | 300 | 580 | 200 | 200 | 220 | | 200 | 220 | 560 | 380 | 420 |
| 210 | 300 | 600 | 200 | 200 | 220 | | 200 | 220 | 580 | 380 | 420 |
| 220 | 300 | 600 | 200 | 200 | 220 | | 200 | 240 | 620 | 400 | 440 |
| 230 | 300 | 620 | 200 | 200 | 220 | | 200 | 240 | 640 | 400 | 440 |
| 240 | 300 | 620 | 200 | 200 | 220 | | 200 | 240 | 640 | 400 | 460 |
| 250 | 300 | 640 | 200 | 200 | 240 | | 200 | 240 | 620 | 400 | 460 |
| 260 | 300 | 640 | 200 | 200 | 240 | | 200 | 260 | 600 | 400 | 480 |
| 270 | 300 | 660 | 200 | 200 | 240 | | 200 | 280 | 580 | 420 | 500 |
| 280 | 300 | 660 | 200 | 200 | 260 | | 200 | 300 | 580 | 420 | 500 |
| 290 | 300 | 680 | 200 | 200 | 260 | | 200 | 300 | 580 | 420 | 500 |
| 300 | 300 | 680 | 200 | 200 | 280 | | 200 | 300 | 600 | 420 | 500 |
| 310 | 300 | 700 | 200 | 200 | 280 | | 200 | 320 | 600 | 440 | 520 |
| 320 | 300 | 700 | 200 | 200 | 280 | | 200 | 340 | 600 | 440 | 520 |
| 330 | 300 | 720 | 200 | 200 | 300 | | 200 | 360 | 640 | 440 | 520 |
| 340 | 300 | 720 | 200 | 200 | 300 | | 200 | 400 | 640 | 440 | 540 |
| 350 | 300 | 740 | 200 | 200 | 300 | | 200 | 400 | 640 | 440 | 540 |
| 360 | 300 | 740 | 200 | 200 | 300 | | 200 | 440 | 660 | 460 | 560 |
| 370 | 300 | 760 | 200 | 200 | 300 | | 200 | 480 | 660 | 460 | 580 |
| 380 | 300 | 760 | 200 | 200 | 320 | | 200 | 500 | 680 | 460 | 600 |
| 390 | 300 | 800 | 200 | 200 | 340 | | 200 | 500 | 700 | 460 | 600 |
| 400 | 300 | 840 | 200 | 200 | 340 | | 200 | 520 | 700 | 480 | 600 |
| 410 | 300 | 900 | 200 | 200 | 360 | | 200 | 540 | 740 | 480 | 620 |
| 420 | 300 | 960 | 200 | 200 | 380 | | 200 | 540 | 760 | 480 | 620 |
| 430 | 300 | 980 | 200 | 200 | 280 | | 200 | 560 | 760 | 500 | 620 |
| 440 | 300 | 1020 | 200 | 200 | 400 | | 200 | 580 | 780 | 500 | 620 |
| 450 | 300 | 1100 | 200 | 200 | 400 | | 200 | 580 | 800 | 500 | 640 |
| 460 | 300 | 1200 | 200 | 200 | 420 | | 200 | 600 | 800 | 500 | 640 |
| 470 | 300 | | 200 | 200 | 440 | | 200 | 620 | 820 | 500 | 660 |
| 480 | 300 | | 200 | 200 | 460 | | 200 | 620 | 840 | 520 | 660 |
| 490 | 300 | | 200 | 200 | 480 | | 200 | 620 | 880 | 520 | 660 |
| 500 | 300 | | 200 | 200 | 520 | | 200 | 620 | 900 | 520 | 680 |
| 510 | 300 | | 200 | 200 | 520 | | 200 | 620 | 940 | 520 | 680 |
| 520 | 300 | | 200 | 200 | 540 | | 200 | 620 | 960 | 520 | 700 |
| 530 | 300 | | 200 | 200 | 560 | | 200 | 620 | 980 | 530 | 700 |
| 540 | 300 | | 200 | 200 | 560 | | 200 | 640 | 1000 | 540 | 700 |
| 550 | 300 | | 200 | 200 | 560 | | 200 | 640 | | 540 | 700 |
| 560 | 300 | | 200 | 200 | 600 | | 200 | 640 | | 540 | 720 |
| 570 | 300 | | 200 | 200 | 600 | | 200 | 640 | | 540 | 720 |
| 580 | 300 | | 200 | 200 | 620 | | 200 | 660 | | 540 | 720 |
| 590 | 300 | | 200 | 200 | 620 | | 200 | 660 | | 560 | 740 |
| 600 | 300 | | 200 | 200 | 620 | | 200 | 660 | | 560 | 740 |

As shown in Table 4, the mixture of silicone 3073 and 2-PH mixture and the mixture of ACP 1400 and 2-PH showed some surprisingly improved synergistic performance. Thus, the presence of 2-PH improves both the knock down and persistence performance over pure silicone foam control agents.

TABLE 4

Experimental results of foam control agent mixtures

| | Examples | | | | | |
|---|---|---|---|---|---|---|
| Time (seconds) | Example 6 Foam Volume (mL) | Example 7 Foam Volume (mL) | Example 8 Foam Volume (mL) | Comparative Example 7 Foam Volume (mL) | Comparative Example 8 Foam Volume (mL) | Comparative Example 9 Foam Volume (mL) |
| 0 | 1000 | 1000 | 1000 | 1000 | 1000 | 1000 |
| 5 | 340 | 420 | 460 | 400 | 440 | 720 |
| 10 | 340 | 400 | 460 | 380 | 440 | 660 |
| 15 | 340 | 400 | 460 | 400 | 440 | 600 |
| 20 | 340 | 400 | 460 | 380 | 440 | 560 |
| 25 | 340 | 400 | 460 | 380 | 440 | 540 |
| 30 | 340 | 420 | 460 | 400 | 440 | 520 |
| 35 | 340 | 420 | 480 | 400 | 440 | 520 |
| 40 | 340 | 420 | 480 | 400 | 460 | 520 |
| 45 | 340 | 420 | 500 | 400 | 460 | 520 |
| 50 | 340 | 420 | 500 | 400 | 460 | 520 |
| 55 | 340 | 420 | 520 | 400 | 460 | 520 |
| 60 | 340 | 440 | 520 | 400 | 480 | 520 |
| 70 | 340 | 440 | 540 | 400 | 480 | 520 |
| 80 | 360 | 460 | 560 | 400 | 480 | 520 |
| 90 | 360 | 460 | 580 | 400 | 480 | 540 |
| 100 | 360 | 460 | 620 | 400 | 500 | 560 |
| 110 | 360 | 480 | 640 | 400 | 500 | 580 |
| 120 | 360 | 480 | 680 | 400 | 500 | 600 |
| 130 | 360 | 480 | 740 | 400 | 500 | 620 |
| 140 | 360 | 500 | 800 | 400 | 500 | 660 |
| 150 | 360 | 500 | 860 | 420 | 520 | 680 |
| 160 | 360 | 520 | 900 | 420 | 520 | 720 |
| 170 | 360 | 520 | 940 | 420 | 520 | 760 |
| 180 | 360 | 520 | 980 | 420 | 540 | 800 |
| 190 | 360 | 540 | 1020 | 420 | 540 | 860 |
| 200 | 360 | 540 | | 420 | 540 | 920 |
| 210 | 360 | 560 | | 420 | 560 | 980 |
| 220 | 360 | 580 | | 420 | 560 | 1040 |
| 230 | 360 | 580 | | 420 | 580 | 1100 |
| 240 | 380 | 600 | | 440 | 580 | |
| 250 | 380 | 600 | | 440 | 600 | |
| 260 | 380 | 620 | | 440 | 600 | |
| 270 | 380 | 620 | | 440 | 620 | |
| 280 | 380 | 660 | | 440 | 620 | |
| 290 | 380 | 660 | | 440 | 640 | |
| 300 | 380 | 680 | | 460 | 640 | |
| 310 | 380 | 700 | | 460 | 660 | |
| 320 | 380 | 700 | | 460 | 660 | |
| 330 | 380 | 720 | | 460 | 680 | |
| | | 740 | | 460 | 700 | |
| 350 | 400 | 760 | | 460 | 700 | |
| 360 | 400 | 760 | | 480 | 720 | |
| 370 | 400 | 780 | | 480 | 740 | |
| 380 | 400 | 800 | | 480 | 760 | |
| 390 | 400 | 800 | | 500 | 760 | |
| 400 | 400 | 820 | | 500 | 780 | |
| 410 | 400 | 840 | | 500 | 800 | |
| 420 | 400 | 860 | | 500 | 800 | |
| 430 | 420 | 860 | | 520 | 820 | |
| 440 | 420 | 880 | | 520 | 840 | |
| 450 | 420 | 880 | | 520 | 860 | |
| 460 | 420 | 900 | | 540 | 880 | |
| 470 | 420 | 920 | | 540 | 880 | |
| 480 | 420 | 920 | | 540 | 900 | |
| 490 | 420 | 940 | | 540 | 920 | |
| 500 | 440 | 940 | | 560 | 940 | |
| 510 | 440 | 940 | | 560 | 960 | |
| 520 | 440 | 960 | | 580 | 960 | |
| 530 | 440 | 960 | | 580 | 980 | |
| 540 | 440 | 980 | | 580 | 980 | |
| 550 | 460 | 980 | | 600 | 1000 | |
| 560 | 460 | 980 | | 600 | 1000 | |
| 570 | 460 | 980 | | 600 | 1020 | |
| 580 | 460 | 1000 | | 600 | 1020 | |
| 590 | 460 | 1000 | | 600 | 1040 | |
| 600 | 480 | 1000 | | 620 | 1040 | |

The invention claimed is:

1. A method of controlling foam for paper and pulp production comprising the step of adding a foam control agent to a black liquor of the pulp and paper production process, wherein the foam control agent comprises 2-propylheptanol.

2. The method of claim 1, wherein at least one other foam control agent or hydrophobic material is added.

3. The method of claim 1, wherein a silicone is also added.

4. The method of claim 1 wherein the foam control agent includes a surfactant, and the surfactant is an alkoxylate of a branched alcohol that has the structure of:

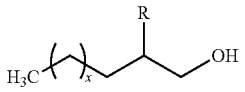

wherein x is an integer from 2 to 7 and R is an alkyl group with 1 to 6 carbon atoms, and wherein the branched alcohol has from 8 to 12 carbon atoms.

5. The method of claim 1 wherein the foam control agent further comprises one or more of the following additional components:

a) random or block copolymers composed of ethylene oxide, propylene oxide and/or butylene oxide;

b) silicone;

c) wax;

d) oil;

e) silica;

f) surfactant;

g) water; and h) solvent.

* * * * *